United States Patent [19]

Smith

[11] 4,307,773

[45] Dec. 29, 1981

[54] FLUID BED HEAT EXCHANGER FOR CONTAMINATED GAS

[76] Inventor: Richard D. Smith, 2415 South Ct., Palo Alto, Calif. 94301

[21] Appl. No.: 937,270

[22] Filed: Aug. 28, 1978

[51] Int. Cl.[3] ..... F28D 13/00; F28D 15/00

[52] U.S. Cl. ..... 165/1; 165/104.16; 165/104.18; 34/57 A; 55/390; 55/267

[58] Field of Search ..... 165/104 F, 107, 1, 104.16, 165/104.15, 104.18; 34/57 A; 55/390, 267

[56] References Cited

U.S. PATENT DOCUMENTS

| | | | |
|---|---|---|---|
| 2,537,044 | 1/1951 | Garbo | 165/107 X |
| 2,580,635 | 1/1952 | Winter, Jr. | 165/107 X |
| 2,665,971 | 1/1954 | Lewis et al. | 165/104 F X |
| 2,697,653 | 12/1954 | Nicholson | 165/104 F X |
| 2,702,091 | 2/1955 | Smith, Jr. | 165/107 X |
| 2,995,426 | 8/1961 | Keith | 165/104 F X |
| 3,619,422 | 11/1971 | Rummel et al. | 165/107 X |
| 3,981,355 | 9/1976 | Squires | 165/107 X |

FOREIGN PATENT DOCUMENTS

| | | | |
|---|---|---|---|
| 523473 | 4/1956 | Canada | 165/104 F |
| 678674 | 9/1952 | United Kingdom | 165/107 |
| 986110 | 10/1959 | United Kingdom | 165/104 |
| 567897 | 8/1977 | U.S.S.R. | 165/104 F |

*Primary Examiner*—Albert W. Davis
*Attorney, Agent, or Firm*—Phillips, Moore, Weissenberger, Lempio & Majestic

[57] ABSTRACT

A heat exchanger is presented in which heat from a hot contaminated fluid stream is transferred to granular media of a fluid bed. Such streams can issue from, for example, manufacturing processes such as glass furnaces, and magnetohydrodynamic power plant. The hot fluid stream is used to fluidize the media; ash, slag, condensed vapors and other contaminants often found therein are deposited on the media. The bed is kept from fouling by diluting the contaminants with large quantities of media and by keeping the media of the bed highly active. Heat is transferred to the media and is subsequently transferred from the heated media to a second fluid stream either by removing the media from the bed and contacting it directly with the second fluid stream or by submerging conduits in the fluid bed and directing the second fluid stream therethrough. Where a high effectiveness for the heat exchanger is desired, the hot fluid stream is passed through two or more fluid beds in series and the media flows from fluid bed to fluid bed, countercurrent to the flow of the hot fluid stream. Contaminants can be recovered from the media, from the fluid beds and from the exhaust fluid from the fluid beds.

12 Claims, 18 Drawing Figures

FLUID BED HEAT EXCHANGER FOR CONTAMINATED GAS

BACKGROUND OF THE INVENTION

1. Technical Field

This invention relates to an apparatus and method for transferring heat from a hot, contaminated, fluid stream to a second fluid stream and, for heating the second stream to a temperature approaching the temperature of the hot fluid stream. In addition, the invention relates to an apparatus and method for removing the majority of the contaminants from the hot fluid stream directly and also for reducing the temperature of the hot fluid stream sufficiently so that the contaminants behave as a dust and can be removed by conventional means.

2. Background Art

Exhaust gas from the combustion of coal and the exhaust gas from certain other processes, such as lime calcining, contain mixtures of contaminants including minerals and alkali salts which were originally combined with the fuel such as the coal, or the feed material, such as the lime, as it was mined from the earth. At temperatures up to 1700° F., these chemically complex mixtures of contaminants generally behave as free-flowing solid particles. The contaminants settle on heat transfer surfaces such as boiler tubes, but can be removed by soot blowers. Their presence in the gas stream does, however, preclude the use of intricate, extended surface heat transfer devices.

As the temperature of the hot exhaust gas stream and hence the contaminant particles increases above 1700° F. to 2000° F., some of the constituents soften into sticky particles, and eventually the particles form a mass of liquid slag. At temperatures of 2600° F. and above, some of the alkali salts become vaporized and are carried with the gas as a vapor. The heat transfer from a contaminated or dirty gas stream to another gas stream at these elevated temperatures is difficult because the sticky contaminants collect on heat transfer surfaces and foul the heat exchanger. In addition, the contaminants, in their liquid state, wet the heat exchanger surface and the alkali, sulfur, and chlorine, which the contaminants normally contain, cause hot corrosion of these surfaces. Normally, the solution to this problem is either (1) to cool the contaminated gas to a lower temperature prior to heat transfer by dilution, as taught in the case of a lime calciner by U.S. Pat. No. 3,998,929, issued to Leyshon, or (2) to transfer the heat to a surface well below the 1700° F. to 2000° F. temperature limits as, for example, in the case of a pulverized coal utility boiler. In either case, the benefit from the elevated temperature is lost.

In industrial processes that must operate at elevated temperatures of 2500° F. and above, such as, for example, glass furnaces and blast furnaces, brick checkers are ued to absorb the heat from the exhaust gas and return it to the process by alternating the flow of hot exhaust gas and incoming air thereover. These simple heat transfer devices will operate with only a limited amount of contaminants in the hot exhaust stream. In addition, the crude brick checkers will not deliver an average preheat air temperature approaching the exhaust gas temperature. For example, a typical blast furnace checker absorbs heat from an exhaust stream at 2900° F., but only delivers air preheated to 2300° F.

Nowhere is the requirement to preheat incoming air more severe than in a magnetohydrodynamic (MHD) power plant. To maintain reasonable efficiencies, the incoming air must be preheated to 2500° F. (with 2900° F.–3200° F. desired) from an exhaust gas stream at 3600° F. The exhaust gas stream can contain, for example, 0.4% coal slag and 3% potassium sulfate, if high sulfur coal is burned. It is noted that potassium carbonate is added to the gas stream to provide ions which are necessary to generate electric power in MHD systems. The potassium combines with sulfur in the coal to form potassium sulfate in the exhaust gas stream. Corrosion of the refractory, surface deposition, and corrosion of boiler tubes by liquid potassium sulfate are the major potential problems. A successful MHD air preheater using exhaust gases is yet to be built.

Fluidized beds are well known in the art, and have been used in industry for many years for a variety of applications. Their first widespread use was for petroleum catalytic crackers during World War II. Since that time, they have been used in industry for ore roasting, lime calcining, drying, heat treating of metals, and, most recently, for the combustion of low grade solid fuel, including high sulfur coal.

One of the many advantageous features of fluid beds is the excellent heat transfer between the incoming gas and the media due to the large surface area of the media and the turbulent action of the bed. Likewise, the heat transfer from the media to a body submerged in the bed is also excellent. U.S. Pat. No. 3,912,002, issued to Elliot, teaches the use of a shallow fluid bed with finned tubes buried therein to make a compact heat exchanger. U.S. Pat. No. 3,982,901, issued to Steever, teaches the immersion of boiler tubes in a coal-burning fluid bed at 1700° F. to produce steam. None of the above, however, teaches the use of the fluid bed to nullify the deleterious effects of the contaminant in the hot gas while simultaneously using the well known heat transfer features. In fact, these fluid beds would quickly become ineffective were contaminated hot gas directed therethrough.

Beds of granular media have been used to filter gases. For example, see U.S. Pat. No. 4,012,210, issued to Morris; U.S. Pat. No. 4,017,278 issued to Reese; and U.S. Pat. No. 3,940,237 issued to Gonzalez, which teach the use of a slowly moving packed bed to filter particulate from a gas, heat transfer not being a consideration. U.S. Pat. No. 3,953,190, issued to Lange, teaches the use of a slowly moving packed bed to filter the exhaust of a glass furnace and preheat the incoming charge, which charge is in fact the packed bed. U.S. Pat. No. 3,847,094, issued to Taeymans, et al, teaches the passage of the exhaust gas stream of an incinerator through a fluidized bed but only for the purpose of incinerating the unburned particles.

DISCLOSURE OF THE INVENTION

The present invention is directed toward overcoming one or more of the problems as set forth above.

According to the present invention, there is disclosed an apparatus for transferring heat from a hot, contaminated fluid stream which can contain contaminants including solid particles, semi-solid particles, liquid particles, and condensable vapors, into another fluid stream. The apparatus comprises a fluid bed heat exchanger including a housing containing granular media. A first conduit in fluid communication with the fluid bed directs the hot, contaminated fluid stream to the fluid bed heat exchanger. The fluid stream fluidizes the granular media with the accompanying transfer of heat and contaminants from the fluid stream to the granular media. The apparatus further includes a mechanism for maintaining the fluidization of the fluid bed heat exchanger which includes a conduit for the addition of uncontaminated granular media to the fluid bed and a conduit for the removal of contaminated granular media from the fluid bed. The contaminated media removed from the fluid bed is delivered to another heat exchanger. The another fluid stream is directed through the another heat exchanger whereupon heat is transferred from the contaminated granular media to the An aspect of the invention includes a conduit for directing the granular media from the another heat exchanger to a device for removing the contaminant from the granular media. The contaminants are recovered separately from the granular media, which granular media is directed from the contaminant removal device through another conduit back to the fluid bed heat exchanger.

Still another aspect of the invention includes a fluid bed heat exchanger having a plurality of fluid beds, the granular media flowing from bed to bed countercurrent to the flow of hot contaminated fluid through the beds.

The invention further includes the method of transferring heat from the above-described hot, contaminated fluid stream to another fluid stream, which method comprises the steps of fluidizing a bed of granular media by passing the hot, contaminated fluid stream therethrough; simultaneously heating the granular media with the fluid stream and transferring some of the contaminants from the stream to the granular media; maintaining fluidization of the bed of adding uncontaminated media thereto and removing contaminated media therefrom; and transferring heat from the contaminated media removed from the bed to the another fluid stream.

The method further includes the step of removing the contaminants from the contaminated media, after heat has been transferred therefrom to the another fluid stream; and returning the uncontaminated media to the fluid bed.

It can be seen that as the another fluid stream is heated through contact with the media, the present invention allows this transfer to occur with a high level of energy recovery at a temperature approaching the temperature of the hot, contaminated fluid stream. In the prior art, the contaminated fluid had to be either diluted to reduce the temperature thereof or passed over a surface which was maintained at a considerably lower temperature in order to effect heat transfer without fouling of the heat transfer device. Such prior art devices thus have lower levels of energy recovery and lower exit temperatures than are required in many applications.

The present invention, however, allows this highly efficient heat exchange to occur at the elevated temperatures without the contaminants, which become sticky at such elevated temperatures, fouling the heat exchanger.

After heat has been transferred from the contaminated media to the another fluid stream, at the efficiencies afforded by the high temperature transfer, the then cool media can be processed for contaminant removal by conventional means which operate satisfactorily at lower temperatures. The recovered contaminants can become useful by-products. Further, in some situations, as in the MHD example, a successful recovery of the potassium is necessary for the economic operation of the MHD power plant.

Further advantages of the invention will become apparent from the following discussion of the invention.

BEST MODE FOR CARRYING OUT THE INVENTION

Figure 1:
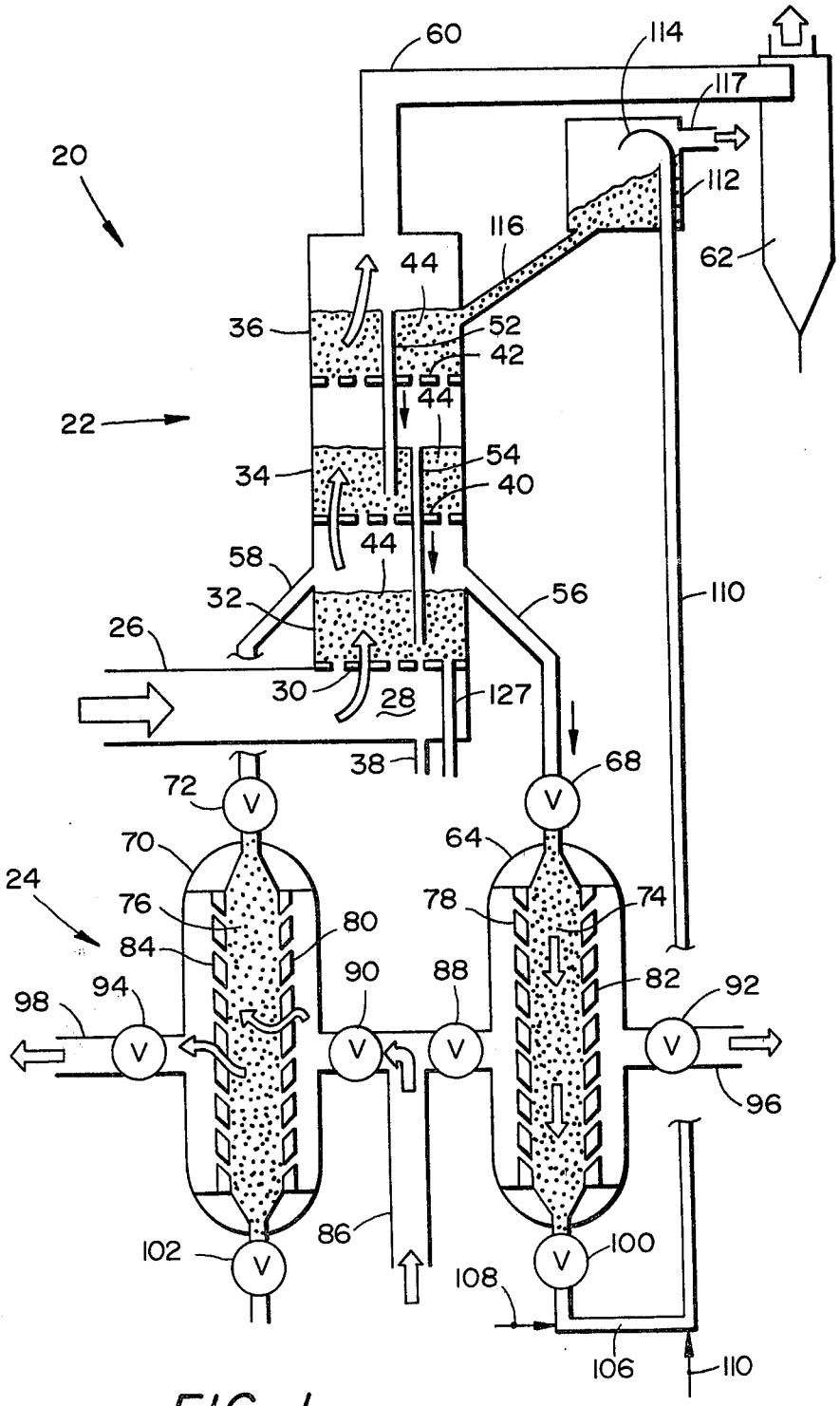
FIG. 1 is a diagrammatical view of an embodiment of the present invention.

With reference to the figures and in particular to FIG. 1 a high temperature, contaminated gas heat exchanger is depicted and generally denoted 20. Heat exchanger 20 includes a fluid bed heat exchanger unit 22 and a vertical panel heat exchanger unit 24. Fluid bed heat exchanger unit 22 includes a duct arrangement 26 which directs the hot, contaminated gas stream to a plenum chamber 28. A distributor plate 30 is positioned above the plenum chamber for distributing the hot, contaminated gas stream to the first of the series of fluid beds of unit 22, which fluid beds are denoted by the numbers 32, 34 and 36. In passing from the duct 26 through the plenum chamber 28 and the distributor plate 30 to the fluid bed 32, the most upstream fluid bed, portions of the solid, liquid, and semi-solid contaminants which are found in the high temperature, contaminated gas stream contact the wall of the plenum chamber 28 and the distributor plate 30. Drains 38 in fluid communication with the plenum chamber 28 allow accumulated liquid contaminants to be drained from the chamber.

Second fluid bed 34 and third fluid bed 36 also have second and third distributor plates 40 and 42 associated respectively therewith. Granular media 44 is contained in the first, second and third fluid beds. The hot contaminated gas flows through the plenum chamber 28 and is distributed by distributor plate 30 through the granular media of first fluid bed 32. The dynamics of the fluid beds are discussed hereinbelow during a more detailed discussion of said fluid beds. The gas exhaust from the first fluid bed 32 exits with a lower temperature and a smaller contaminant concentration. The exhaust gas is directed to the second distributor plate 40 and therefrom is distributed through the granular media of the second fluid bed 34. Again some of the contaminants are removed from the stream by the second fluid bed and the gas exits from the second fluid bed at a lower temperature. The gas stream is then directed to the third distributor plate 42 for distribution through the granular media of the third fluid bed 36.

Countercurrent to the flow of the contaminated gas stream, the media flows continuously from the third fluid bed 36 to the second bed 34 to the first fluid bed 32 and subsequently exits the first fluid bed. To accomplish this counterflow, a series of conduits or downcomers 52, 54, 56 and 58 are provided. Conduit 52 provides communication between the surface of the granular media of the third fluid bed 36 and an internal portion of the media bed of the second fluid bed 34. As uncontaminated media is added to the third fluid bed 36, which addition of media will be described in more detail hereinbelow, third fluid bed 36 overflows into conduit 52 and granular media which has been heated in the third fluid bed and which has acquired certain contaminants is delivered to the second fluid bed 34. The head of granular media from the third fluid bed in the conduit 52 forms a pressure seal therein such that there is no short circuit of gas flow from the second fluid bed 34 through conduit 52, and thus around the third fluid bed 36. Similarly, conduit 54 delivers the overflow of heated and contaminated media from the second fluid bed 34 to the first fluid bed 32. Conduits 56 and 58 remove the overflow of heated and contaminated media from the first fluid bed as media from the second fluid bed is distributed thereto.

In general the staging of the fluid beds with countercurrent media flow approximates a conventional countercurrent heat exchanger. The larger the number of fluid bed stages selected, the more nearly a true countercurrent heat exchanger will be approached. The disadvantage of adding more fluid beds is that there is an increase pressure drop. Thus, practical considerations would limit the number of fluid beds serially communicating, in a preferred embodiment, to perhaps four.

Depending on the particular application, the temperature level of the most downstream fluid bed, the third fluid bed 36, is chosen to be low enough, 1700° F. or below in a preferred embodiment, so that any remaining contaminant in the fluid stream are not sticky, and in fact, behave as a powder. The method of selection of the temperature level of each of the said fluid beds is more fully described hereinbelow. With the contaminants in powder form, the granular media 44 of the third fluid bed 36 will grind up the powder contaminants and elutriate these contaminants as dust in the exit gas which flows from the third fluid bed through conduit 60. From conduit 60, the exhaust gas and dust is collected in a conventional cyclone 62 where the dust is separated from the exit gases. The exit gases then leave the cyclone, now free from the sticky and corrosive contaminants and thus can be conducted through conventional means for further heat transfer and further process use.

The media which is removed from the first fluid bed 32 through conduits 56 and 58 is delivered to the vertical panel heat exchanger unit 24. As can be seen in FIG. 1, conduit 56 delivers hot contaminated media to a first vertical panel heat exchanger 64. A hot media valve, described more fully hereinbelow, regulates the flow of media through conduit 56 to first vertical panel heat exchanger 64. Conduit 58 delivers hot contaminated media to the second vertical panel heat exchanger 70 and another hot media valve 72 regulates the flow of media through conduit 58 to vertical panel heat exchanger 70. Hot media valves 68 and 72 form a pressure seal in the conduits and thus isolate the vertical panel heat exchangers from the first fluid bed.

Vertical panel heat exchangers 64 and 70 include vertical panels 74 and 76 respectively. Vertical panels 74 and 76 include gas inlet louvres 78 and 80, respectively, and gas outlet louvres 82 and 84 respectively. The structure of the heat exchangers 64 and 70 and the louvres are described more fully hereinbelow.

A stream of gas to be heated is provided to the vertical panel heat exchanger unit 24 by conduit 86. Conduit 86 is in fluid communication with the inlet gas valves 88 and 90 of first and second vertical panel heat exchanger 64 and 68, respectively. Further outlet gas valves 92 and 94 of said vertical panel heat exchangers regulate the exhaust of the heated second gas stream from said vertical panel heat exchangers through conduits 96 and 98, respectively. The exit of granular material from said vertical panel heat exchangers 64 and 70 is controlled by media exit valves 100 and 102 respectively.

The first and second vertical panel heat exchangers 70 and 72 are used alternatively. That is to say that hot contaminated media from the first fluid bed 32 is initially provided to the first vertical panel heat exchanger 64 through the hot media valve 68. Then the second stream of gas to be heated is directed through the first vertical panel heat exchanger such that an exchange of heat takes place between the media and the gas. While this exchange occurs, the hot media valve and the media exit valve of the second vertical panel heat exchanger are opened to allow hot contaminated media flow into the second vertical panel heat exchanger and to allow cooled media to flow out of the heat exchanger. When the media in the first vertical panel heat exchanger has cooled to an appropriate temperature, the second gas stream to be heated is directed to the second vertical panel heat exchanger, the first vertical panel heat exchanger then being resupplied with hot contaminated media and cooled media exits through valve 100.

As the cooler, contaminated media exits through opened valve 100, it is delivered to a pneumatic lift arrangement 104. Pneumatic lift arrangement 104 includes a conduit 106 including air jets 108 and 109 represented by arrows. The air jets are located at the bends in the conduit 106 and urge the contaminated media through the conduit 106 and finally up elongated communicating conduit 110 to a media disengagement vessel 112. It is to be understood that, although not shown, there is an identical pneumatic lift arrangement associated with the exit valve 102 which also lifts cooled media, flowing from the second vertical panel heat exchanger, to the media disengagement vessel 112.

Owing to the reduced temperature of the media as the media exits the vertical panel heat exchangers, the contaminants no longer exit as hot sticky substances. Also it is to be remembered that the liquid contaminant was heretofore removed. The movement of the contaminated media through the pneumatic lift arrangement 104 causes the now dry contaminants to be ground up into dust. The dust laden pneumatic lift air is separated from the granular material in the media disengagement vessel 112 and directed through duct 117 to conventional dust removal means such as for example, a cyclone.

In the media disengagement vessel 112, the media is deflected by concave panel 114 and is fed by gravity from disengagement vessel 112, through conduit 116, to the third fluid bed 36.

A more detailed description of the various components of the high temperature contaminated gas heat exchanger 20 follows.

Plenum Chamber And Distributor Plates

Figure 2:
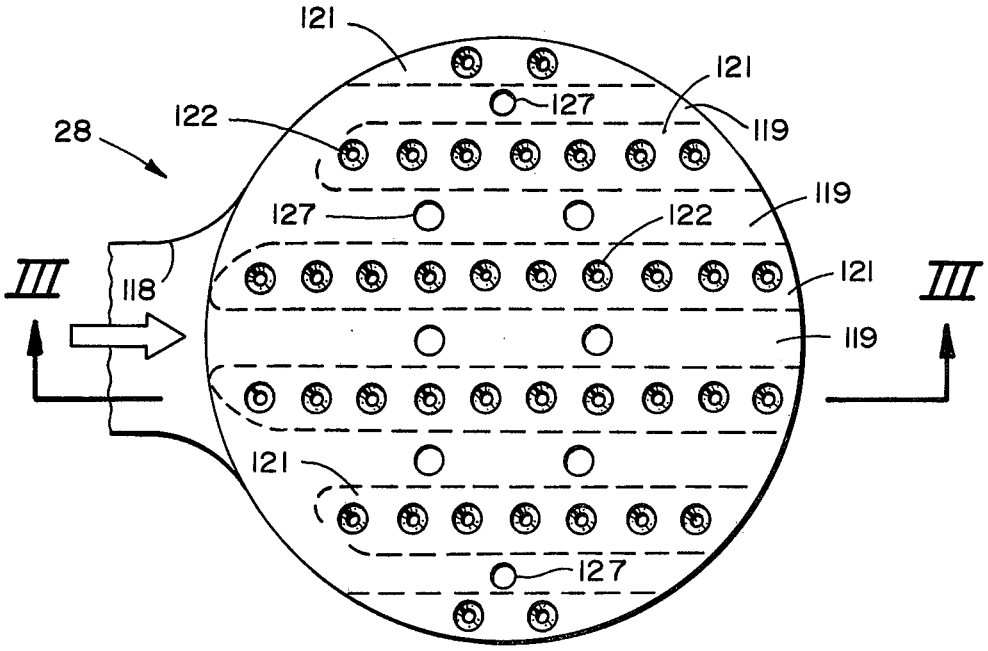
FIG. 2 is a top view of a distributor plate and a plenum chamber as incorporated in the embodiment of the invention in FIG. 1.
Figure 3:
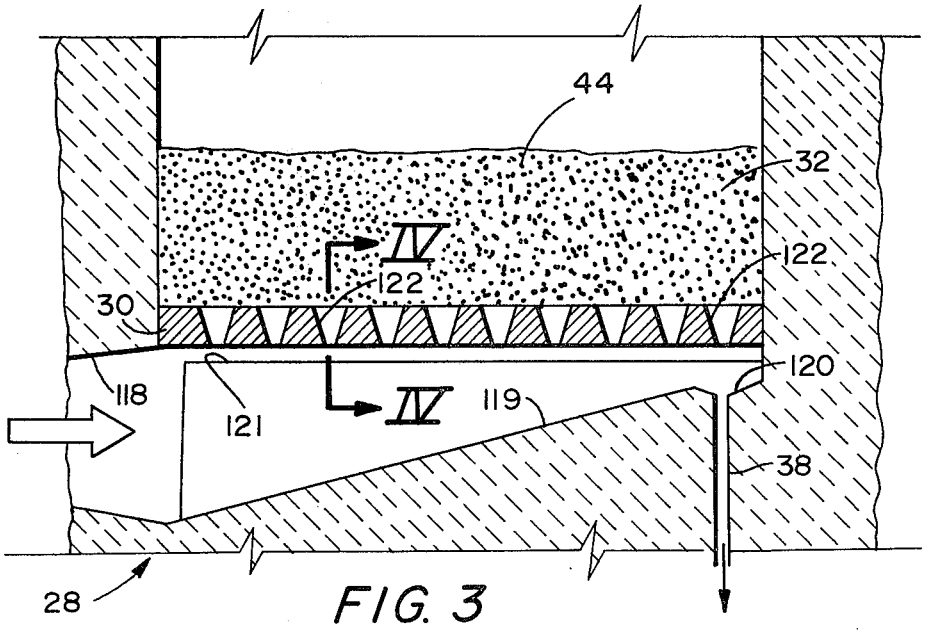
FIG. 3 is a side view taken through line III—III of FIG. 2.

As can be seen in FIG. 3, plenum chamber 28 defines an inlet 118 for the hot, contaminated fluid stream. Further, plenum chamber 28 includes a plurality of upwardly sloping channels 119 (FIGS. 2 and 3). The upwardmost end of each of upwardly sloping channel 119 defines a reservoir 120 which is in fluid communication with one of the drains 38. As the contaminated fluid stream is directed through plenum chamber 28, the liquid contaminant thereof, collects on and is urged up the sloping channels 119 and is deposited in the reservoir 120 whereupon the contaminant drains through drains 38.

Plenum chamber 28 also includes a plurality of elevated, elongated islands 121, one each of said islands 121 located between adjacent sloping channels 119. The upper portion of plenum chamber 28 is defined by the lower surface of distributor plate 30.

Figure 4:
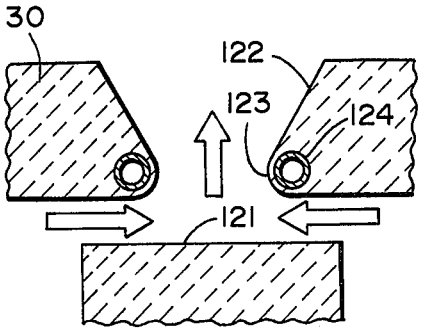
FIG. 4 depicts an enlarged cross-sectional view of a portion of FIG. 3 taken through line IV—IV.
Figure 5:
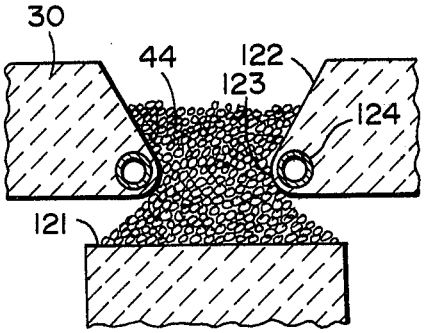
FIG. 5 is a view similar to FIG. 4 with the addition of granular media.

As can be seen in FIGS. 2 and 3, distributor plate 30 includes a plurality of funnel-shaped apertures 122. Apertures 122 are provided in a linear arrangement directly above the islands 121. When the heat exchanger 20 is operational, the stream of contaminated gas flows up the sloping channel 119 as previously indicated and then flows over the islands 121 and finally through funnel-shaped apertures 122 of the distributor plate 30 (FIG. 4). The gases are thereby introduced into the granular media of the first fluid bed 32. During shutdown periods, the granular media as can be seen in FIG. 5 flows under gravity through the apertures 122 of the distributor plate 30 and collects on the islands 121. As can be seen in FIG. 5, the natural angle of repose of the granular media is such that the media stops flowing through the aperture before said media spills over the sides of the islands 121. Such an arrangement avoids the necessity of using conventional bubble caps, apertures smaller than apertures 122 and other devices to prevent the back flow of media. These devices are unsatisfactory as they would easily foul given the contaminants that pass therethrough. Further, as the funnel-shaped apertures 122 have sharply divergent, upwardly sloping, conical sides, plugging of such apertures by the contaminants is prevented as the stream velocity at throat 123 are quite high and as the gap to be plugged becomes divergingly larger. Further funnel-shaped apertures aid in the prevention of back flow of the media through the apertures at shutdown by encouraging media bridging in the apertures.

In a preferred embodiment the apertures diverge at an angle of 45°. Gas flow through such apertures will not follow this divergence but will blast directly into the media of the fluid bed from the throat. Further in a preferred embodiment the distribution plate is placed 2 inches above the islands.

Also as the hot contaminated stream reaches substantial velocities as it passes through apertures 122, a water-cooled torus-shaped conduit 124 cools the throat 123.

The distributor plates 30, 40 and 42 are designed to have a pressure drop sufficient to establish uniform flow across the media of each of the respective fluid beds. This uniform flow can be accomplished with a large number of small apertures or a few large apertures. The large apertures have the advantage of avoiding plugging by the contaminants and also providing a more turbulent fluid bed. The smaller holes have, on the other hand, the advantage of providing a more uniformly fluidized bed and superior heat transfer to the bed. For the present embodiment, the heat transfer from the contaminated gas to the media of the beds is more than adequate. Further as turbulence is highly desirable to offset the damping action of the contaminants which become sticky at elevated temperatures and attempt to aggregate the media, in a preferred embodiment, there are to be fewer and larger apertures. For example, the diameter of the throat 123 of the apertures can be approximately 3 inches in diameter.

Fluid Bed Heat Exchangers

Turning to the fluid beds, their characteristics are determined by the design of the distributor plate, the choice of the media and the selection of the superficial velocity of the hot contaminated gas stream through the media. The superficial velocity for a fluid bed is defined as a average velocity of the gas through the bed assuming that the granular media is not present. There is a minimum superficial velocity at which fluidization of the media first occurs. The maximum superficial velocity or entrainment velocity is reached when the media of the bed blows away. The range of allowable superficial velocities for a bed is closely linked to the size and density of the media. The media, as is discussed hereinbelow, is selected for each particular application, but in general the media ranges in size from 0.2 mm in diameter to 3 mm in diameter. The superficial velocity is chosen to provide a highly active fluid bed in accordance with the media size and density to avoid the agglomeration of media and contaminants.

Examining the fluid beds more closely and focusing for purposes of discussion on bed 32, (FIG. 6) as previously indicated granular media 44 is supported by the distributor plate 30. As the contaminated gas stream passes through the apertures 122 of the distributor plate 30, the stream will accelerate to a velocity of several hundred feet per second. The partly cooled contaminants will be accelerated with the gas stream but will lag behind in velocity, this especially being true of the larger particles. The gas stream and the entrained particles will be directed against the media of the fluid bed, which media will absorb the momentum, sustaining the turbulence of the bed. The majority of the particulate matter in the gas will contact the media by impaction and will adhere to the media. Gas bubbles form over the apertures of the distributor plate and float to the surface of the bed. A small percentage of the particulate matter entrained in the gas stream will reside in the gas bubbles and will escape from the bed.

As can be seen, the distribution of the apertures in the distributor plate 30 is such that a plurality of active zones 125 of the granular media are set up where there is strong bubble flow and rising media flow. A plurality of quiescent zones 126 are established away from the apertures 122, which quiescent zones experience descending media flow under relatively quiescent conditions. The liquid contaminant portion of the gas stream which impacts with the media will coalesce and flow downwardly to the distributor plate in the quiescent zones. At the base of each quiescent zone is a drain 127 through which the coalesced liquid contaminant can drain from the bed. To provide for the proper establishment of the above indicated zones, a typical fluid bed depth, in a preferred embodiment, is in the range of 0.3 meters to 1 meter. The bed depth is to be minimized as much as possible to reduce the pressure drop of the fluid stream thereacross.

One additional factor which has partially been discussed hereinabove and which is important in determining the flow rate of the media and the depth of the bed is the quantity and physical character of the contaminants in the hot gas stream. The rate flow and the depth of the bed are important as they can be regulated to prevent agglomeration of the media. If the contaminant is a liquid with low viscosity, owing to the various drains previously discussed, there is no severe problem of media agglomeration and fouling of the bed. If the contaminant is a semi-solid, it will adhere to the media and thus the solution to having a free flowing bed is adequate dilution as provided by adequate media flow rate into and out of the bed and adequate bed depth. In the case of semi-solid contaminant adhering to the media, such contaminates are drained from the fluid bed along with the media into the vertical panel heat exchangers. If on the other hand the contaminant is solid, it can agglomerate in the bed and be drained to the vertical panel heat exchangers along with the media. Also as has already been indicated, the turbulent action of the bed can grind up the solid media which is then elutriated from the surface of the bed with the gas stream and eventually separated from the gas stream by cyclone 62.

The distributor plate associated with the next downstream fluid bed is positioned over the adjacent upstream fluid bed such that a shower of granular media from the upper surface of the adjacent upstream bed, which shower is caused by the hot contaminated gas flowing through the media bed, keeps the distributor plate clean of contaminants.

As has been indicated above, it is necessary to exchange the media which has been contaminated in the fluid beds with uncontaminated or less contaminated media in order to keep the beds fluid, so that the sticky contaminants do not agglomerate the granular media. Such exchange is accomplished with previously described overflow conduits 52, 54, 56, 58 and 116. Each fluid bed can be maintained at preselected constant temperatures by receiving a predetermined amount of cooler media and by giving up the same amount of heated media. Thus the temperature level of each bed can be adjusted by altering the flow rate of media and also by altering the incoming temperature of the gas stream. It is to be understood that, in a preferred embodiment, owing to the capacity of the fluid beds and owing to the flow rate of granular material through the overflow conduits, the residence time of the media in the conduits is only a fraction of the time that the media spends in each fluid bed. Also it is noted, given the capacity of the fluid bed, that the incoming gas is cooled to bed temperature shortly after it leaves the distributor plate, and that the flow rate of media in the conduits can be varied over a broad range without upsetting the temperature of the bed. As will become evident later on, maintaining a constant temperature in the fluid beds can become important for the purpose of isolating selected contaminants in selected fluid beds.

Granular Media

With reference to the granular media it is contemplated that in a preferred embodiment the media will include an inert refractory material, generally spherical in shape and generally uniform in size and chosen to withstand the temperature and corrosive nature of the hot contaminated fluid stream. An example of such media can include aluminum oxide spheres which have a diameter of 2 mm. Media of this size has a high surface-to-volume ratio. Thus the media absorbs heat quickly in the fluid bed and thus the media can easily transfer the heat to the secondary gas stream in the vertical panel heat exchangers. This excellent heat transfer characteristic of the media allows the exit temperature of the secondary gas stream in the vertical panel heat exchanger unit 24, described more fully hereinbelow, to approach the media temperature. Such a result is desirable, for the higher the gas exit temperature from the vertical panel heat exchanger, the more efficient the thermal operation of the heat exchanger 20. Another reason for allowing the exit temperature of the secondary gas stream to approach that of the media is that in certain applications the temperature of the media delivered to the vertical panel heat exchangers can be limited due to the corrosive effect of the contaminant in the media at more elevated temperatures. Thus with this limitation, it is most desirable that the exit temperature of the second gas stream approach that of the media.

The media can include sand, limestone, dolomite and other matter and can also be chemically treated to combine with at least some of the contaminants.

Hot Media Valves

Figure 12A:
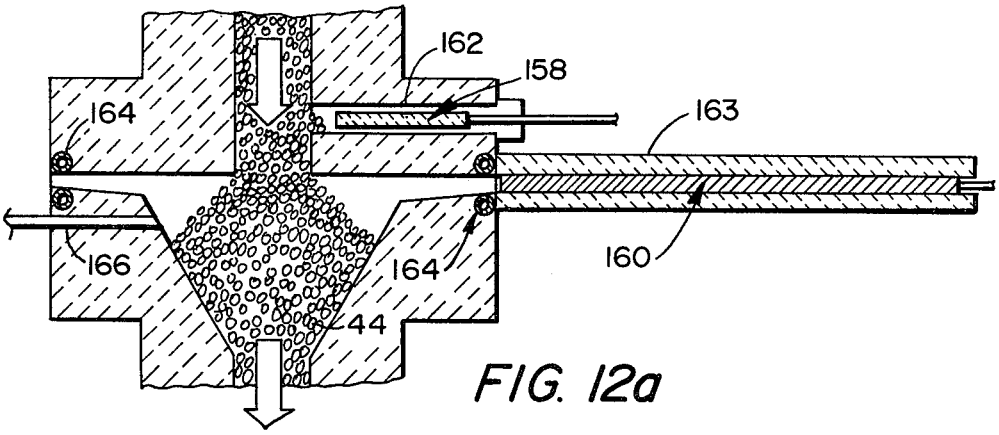
FIGS. 12A, 12B and 12C depict cross-sectional views of a media valve in open, intermediate and closed positions.
Figure 12B:
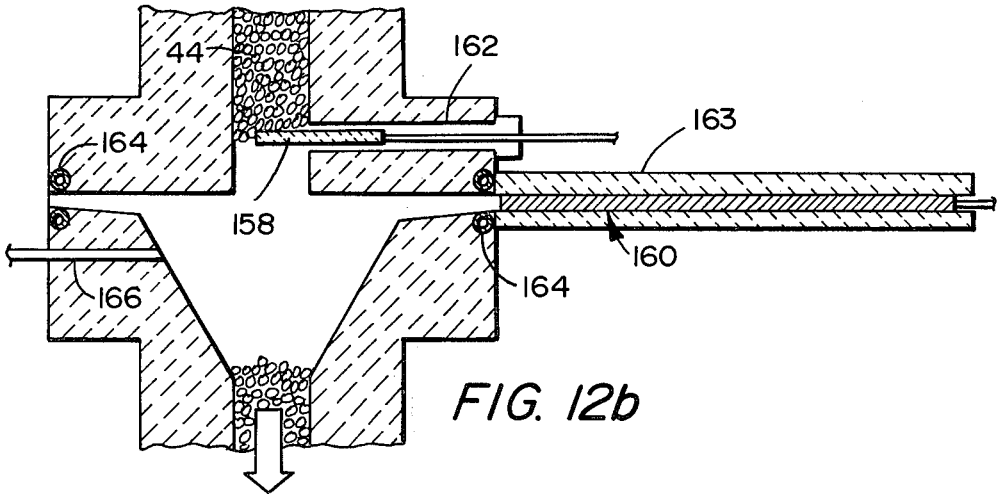
Figure 12C:
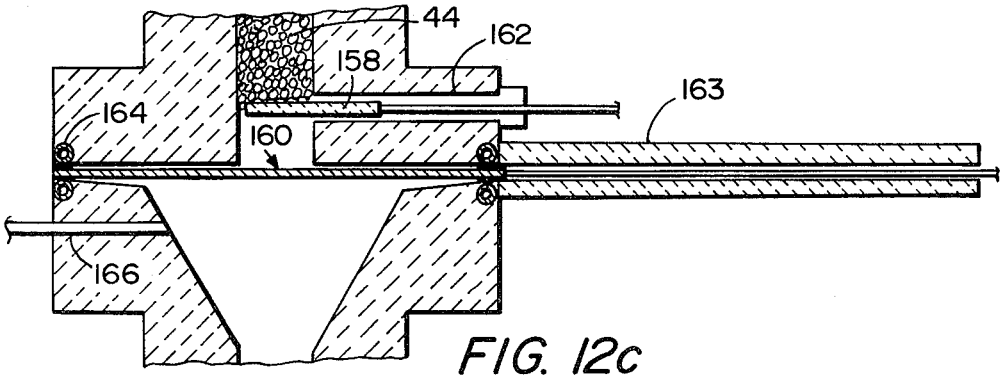

Hot media valve 68 is depicted in FIGS. 12A, 12B and 12C, and it is to be understood that the following discussion applies equally well to hot media valve 72. These valves operate at 3120° F., in a preferred embodiment, and they isolate the fluid bed heat exchanger unit 22 from the vertical panel heat exchanger 24 when the former is at 200 psia and the latter is at about 24 psia in a preferred embodiment.

Valve 68 includes an upper gate 158 and a lower gate 160. The upper gate stops the flow of media and the lower gate provides the 200 psia seal. The upper gate in a preferred embodiment is cast from aluminum oxide, $Al_2O_3$, and retracts into an insulated cave 162 when not in use. The lower gate is made from, for example, stainless steel and is cooled by water provided through conduit 164. Gate 160 is housed in cave 163.

FIG. 12B shows the upper valve actuated to a leftward position so as to stop the media flow. The upper gate has wedged some of the media against a wall of the valve. The force that the upper gate exerts on the media is set to avoid media fracture and also damage to the refractory which defines the wall.

After the upper gate is closed and media has progressed through the valve so as to be clear of the lower gate, a cooling air purge is provided through conduit 166 to reduce the heat of the inner surface of the refractory lining of the valve. The lower gate (FIG. 12C) is then actuated leftwardly to provide a seal.

The upper gate protects the upper surface of the lower gate from direct radiation from the media returned thereabove. The lower surface of the lower gate is protected through the use of the cooling air purge and also as the granular media locked below the lower gate has progressed downwardly away from said gate.

It is to be understood that as the media exiting from the vertical panel heat exchanger unit, in a preferred embodiment, is only 800° F., media exit valves 100 and 102 can be of a conventional nature.

It is to be further understood that other devices such as locked hoppers can be used in place of the hot media valves to transfer hot media between the fluid bed heat exchanger unit 22 and the vertical panel heat exchanger unit 24. A locked hopper 226 (FIG. 13) includes a pressure vessel unit having inlet and outlet port 227 and 228 respectively. Media from unit 22 enters the inlet port at 24 psia. The inlet port is closed and the exit port is opened allowing the media to flow to unit 24 at 200 psia.

Vertical Panel Heat Exchangers

Figure 7:
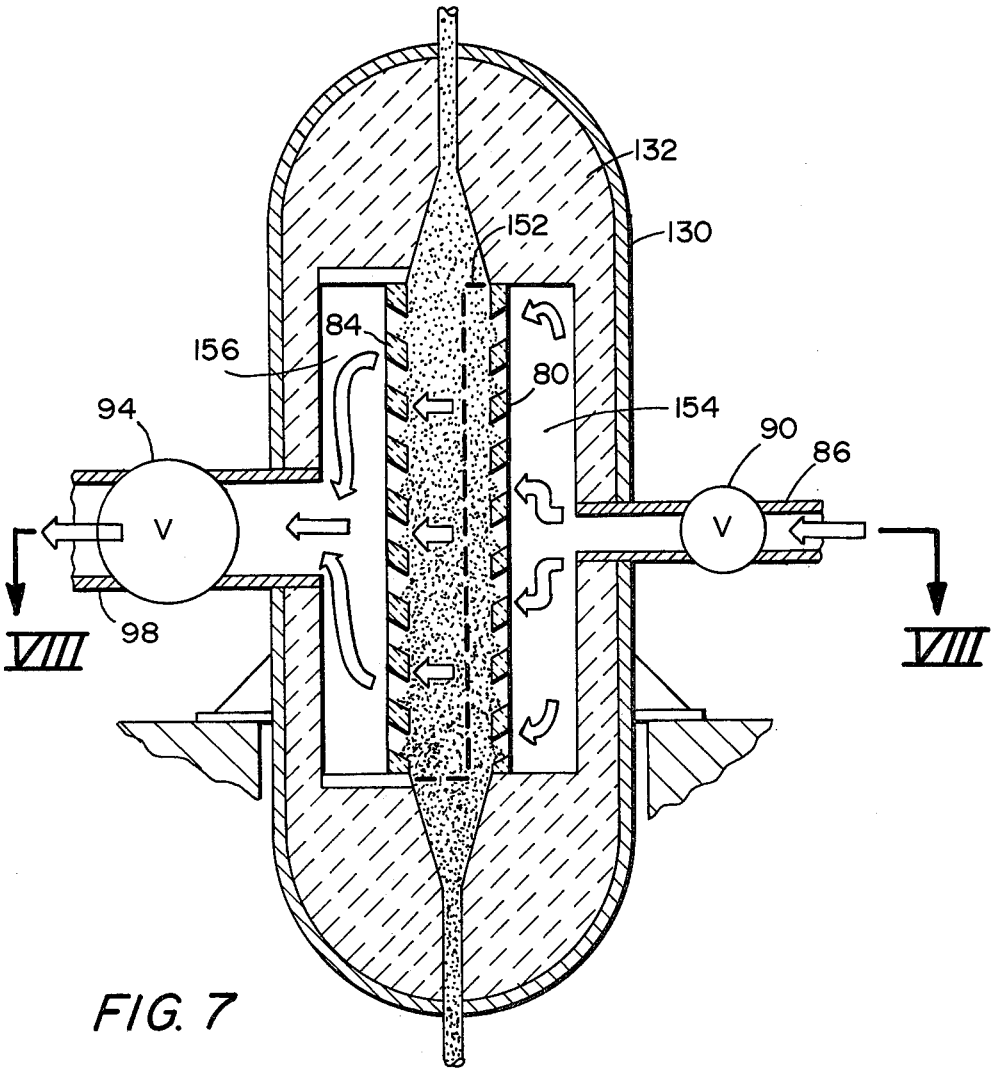
FIG. 7 is a cross-sectional view of a vertical panel heat exchanger which is incorporated into the embodiment of the invention of FIG. 1.
Figure 8:
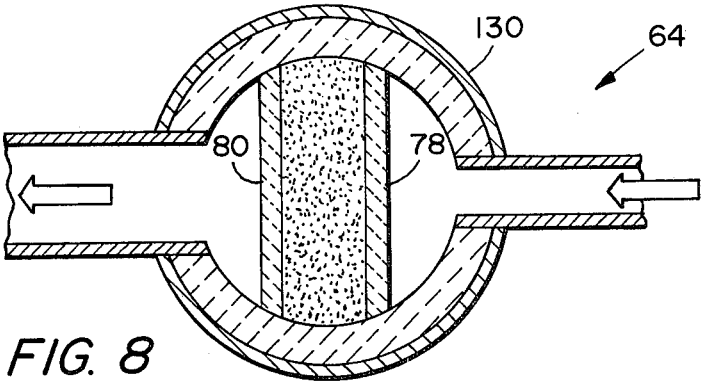
FIG. 8 is a cross-sectional view taken through line VIII—VIII of FIG. 7.

Enlarged and more detailed views of the vertical panel heat exchangers can be seen in FIGS. 7, 8, 9, 10 and 11. Although the vertical panel heat exchanger in FIG. 7 is denoted 70 it is to be understood that the following discussion applies equally well to the first vertical panel heat exchanger 64. Vertical panel heat exchanger 70 includes a pressure vessel 130 (FIG. 7) which is adequately provided with appropriate insulation 132. As can be seen in FIG. 8 the active, heat transfer, portion of the vertical panel heat exchanger is defined in a panel section between gas inlet louvres 78 and gas outlet louvre 82. Inlet manifold 154 distributes the second gas stream from the inlet gas valve 90 to the gas inlet louvres 80. Outlet manifold 156 collects the exhaust gas from the gas outlet louvre 84 and delivers said gas to outlet gas valve 94. As is obvious from FIG. 8 the face of the louvres is much wider than the depth of the media in the heat exchanger and this arrangement affords the good heat transfer characteristics of a vertical panel heat exchanger.

Figure 9:
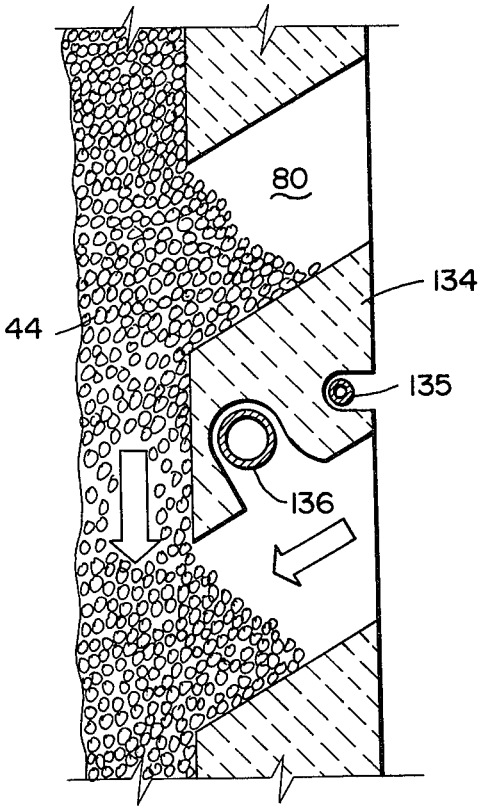
FIG. 9 is a cross-sectional view of several of the inlet louvers of the vertical panel heat exchanger of FIG. 7.

Considering the inlet gas louvres in greater detail and viewing FIG. 9, said louvres are comprised of bricks 134 which rest on horizontal tubes 136 and 138. The bricks 134 are comprised of, in a preferred embodiment, high density aluminum bricks, and the tubes are comprised of stainless steel. The tubes 134 and 136 are cooled by conventional means which includes running water therethrough or also diverting some of the second fluid stream therethrough. It is noted that the bricks slope downwardly in the direction of flow of the media in the vertical panel heat exchanger. So disposed, the spaced bricks allow the second gas stream to pass transversely through the media while allowing the media to come to a natural angle of repose, as indicated in FIG. 9, without overflowing from the inlet louvres. As the granular material flows through the vertical panel heat exchanger, the material that is disposed on the bricks will naturally flow downward under the influence of gravity and thus there will be no pockets of stagnation where media becomes permanently collected. In a preferred embodiment, the bricks are disposed at a 35° angle to the horizontal.

Figure 10:
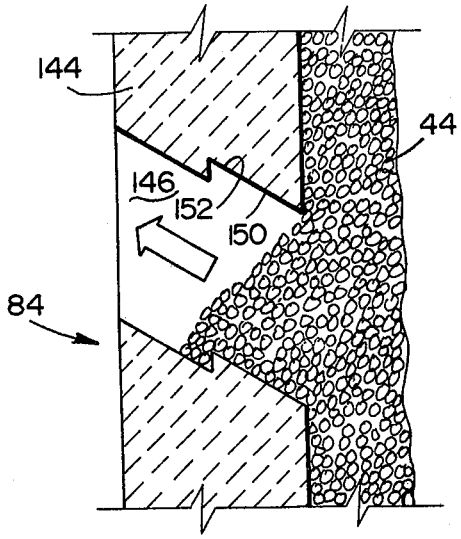
FIG. 10 is a cross-sectional view of several of the exit louvers of the vertical panel heat exchanger of FIG. 7.
Figure 11:
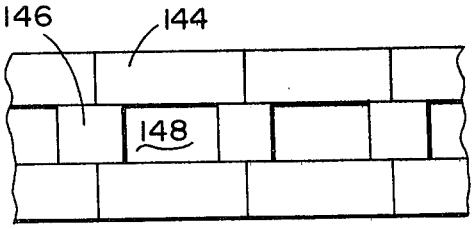
FIG. 11 is a partial front view of the exit louvers of FIG. 10.

FIGS. 10 and 11 depicts the gas outlet louvres 84. Said louvres are in a preferred embodiment comprosed of corrosive resistant bricks 140. The bricks are set at an angle of 45° in a preferred embodiment. The inlet louvres are constructed of alternating layers of elongated bricks 144 and relatively shorter bricks 146, which bricks are spaced apart to form a window 148 through which the second gas stream is exhausted from the vertical panel heat exchanger. Bricks 144 and 146 have stopped interlocking sides 150 and 152 which prevents the sliding of one brick over the other due to the 45° angle of disposition of the bricks.

In the vertical panel heat exchangers 64 and 70, as in the fluid bed heat exchangers 32, 34 and 36, the heat transfer from the granular media to the transverse flow of the second gas stream is excellent due to the large surface area of the granular media, compared to its volume. The dynamics of the vertical panel heat exchangers are such that as the media cools so rapidly, there is a rather sharply defined, stepped, demarcation, for example see line 152 (FIG. 7). This line represents a planar front that moves across the vertical panel heat exchanger as more and more of the media is cooled. On one side of the planar front the media is essentially at the inlet temperature of the second gas stream and on the other side of the front the media is essentially at the exit temperature of the second gas stream.

The smaller the diameter of the media, the more sharply defined is the demarcation. Unfortunately the smaller the media the higher the pressure drop, thus a size compromise must be made. Also heat transfer is aided by transferring heat in and out of the same surface of the media. That is to say heat is transferred in and out of the surface of the media, there being no appreciable loss due to conduction through the media.

Thus it is evident that the effect of the design of the vertical panel heat exchanger is to provide an exit temperature from the second gas stream that is quite close to the media temperature and that remains nearly constant until most of the media has been cooled essentially to the inlet temperature of the incoming secondary gas stream.

A potential hazard in the operation of the vertical panel heat exchangers is that a high percentage of the semi-solid contaminants in the granular media delivered thereto could subsequently freeze the granular media into a rigid block upon cooling. This problem is avoided by providing adequate flow into and out of the fluid bed heat exchangers such that the media delivered to the vertical panel heat exchangers is adequately diluted to insure that the granular media will flow freely after cooling. In actuality, ay agglomerations of semi-solid sticky contaminants and media will shrink and shift considerably during the cooling in the vertical panel heat exchanger, thus promoting breakup of all but the smallest of said agglomerations.

Alternate Embodiments

Figures 13, 16:
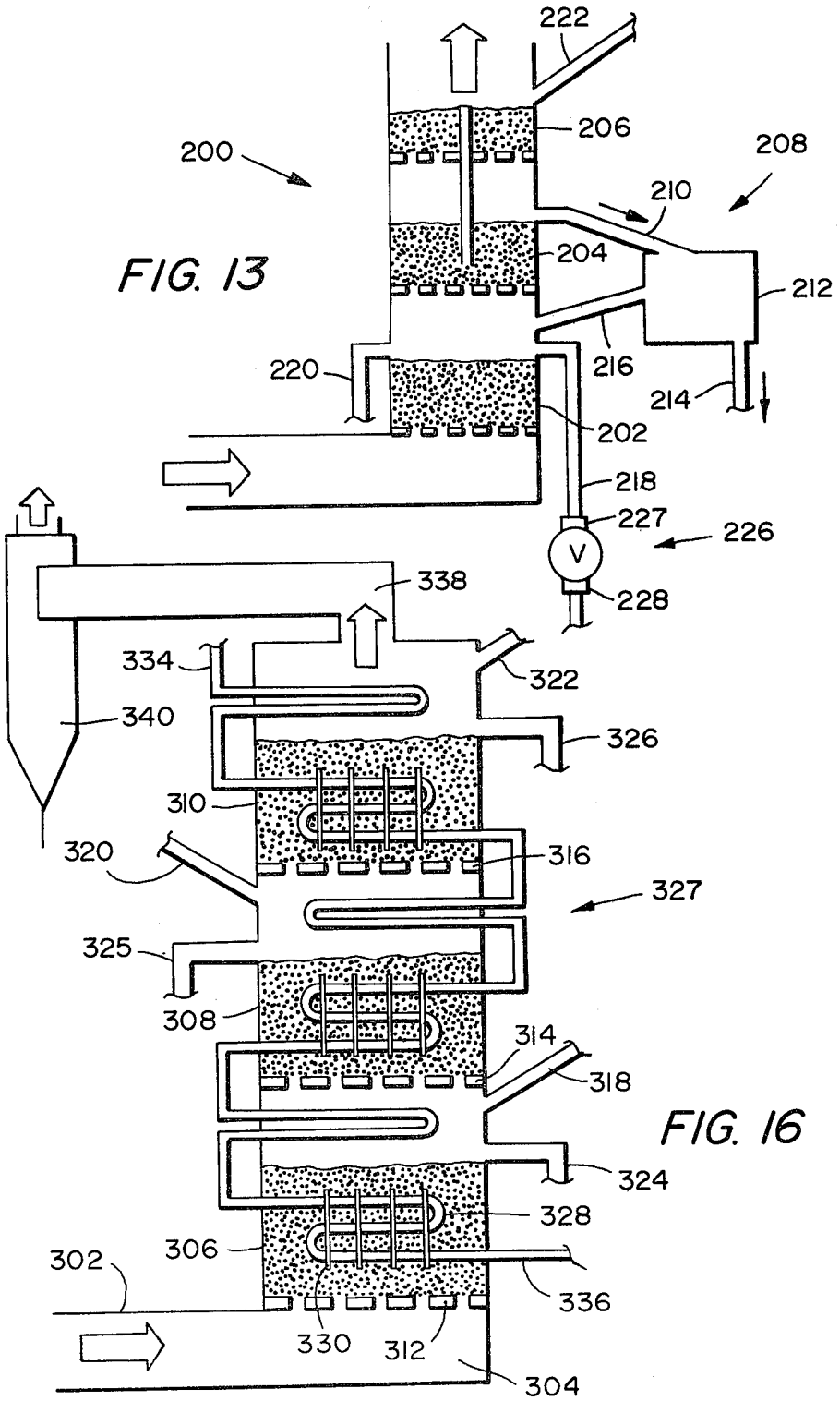
FIG. 13 is a diagrammatic view of an alternative embodiment of the invention wherein contaminant is removed from the granular media as the media passes between the fluid beds.
FIG. 16 is a diagrammatical view of yet another embodiment of the invention wherein conduits are submerged in the media of the fluid beds, which conduits conduct the second gas stream.

A first alternate embodiment of the invention is depicted in FIG. 13. The alternate embodiment includes a heat exchanger unit 200 which includes a plurality of fluid beds 202, 204 and 206. Fluid bed heat exchanger unit 200 operates essentially in the same way as fluid bed heat exchanger unit 22. However, the vertical conduit 54 of the fluid bed heat exchanger unit 22 has been replaced by a conduit arrangement 208 which includes a first conduit 210 which removes the overflow from the second fluid bed 204. Conduit 210 delivers the overflow granular media to a recovery process which is denoted by box 212. Recovery process 212 separates preselected contaminants which have particular value from the media, delivering the separated contaminants to conduit 214 for further processing and returning the cleaned granular media to the first fluid bed 202 by conduit 216. It is noted that the granular material after having passed through the fluid bed heat exchanger unit 202 overflows into conduits 218 and 220 and is thus directed to a vertical panel heat exchanger (not shown) which is similar to the vertical panel heat exchanger unit 24 in FIG. 1. Also after the granular media leaves the vertical panel heat exchanger unit, the contaminants that are still present in the granular media are removed by a process similar to that shown in FIG. 1. After the granular media has been processed, so as to remove the contaminants, the media is again delivered by conduit 222 to the third fluid bed heat exchanger.

This alternate embodiment functions through recovery process 212 to recover one or more desirable contaminants from the gas stream in as pure a form as possible. In such an arrangement the temperature level of a particular bed, and in this case the second fluid bed 204, is predetermined to encourage the condensation of a specific vapor or to encourage adhesion of specific contaminants to the media. The media, so contaminated, then overflows through conduit 210 to the recovery process 212 where the valuable contaminates can be separated.

Figure 14:
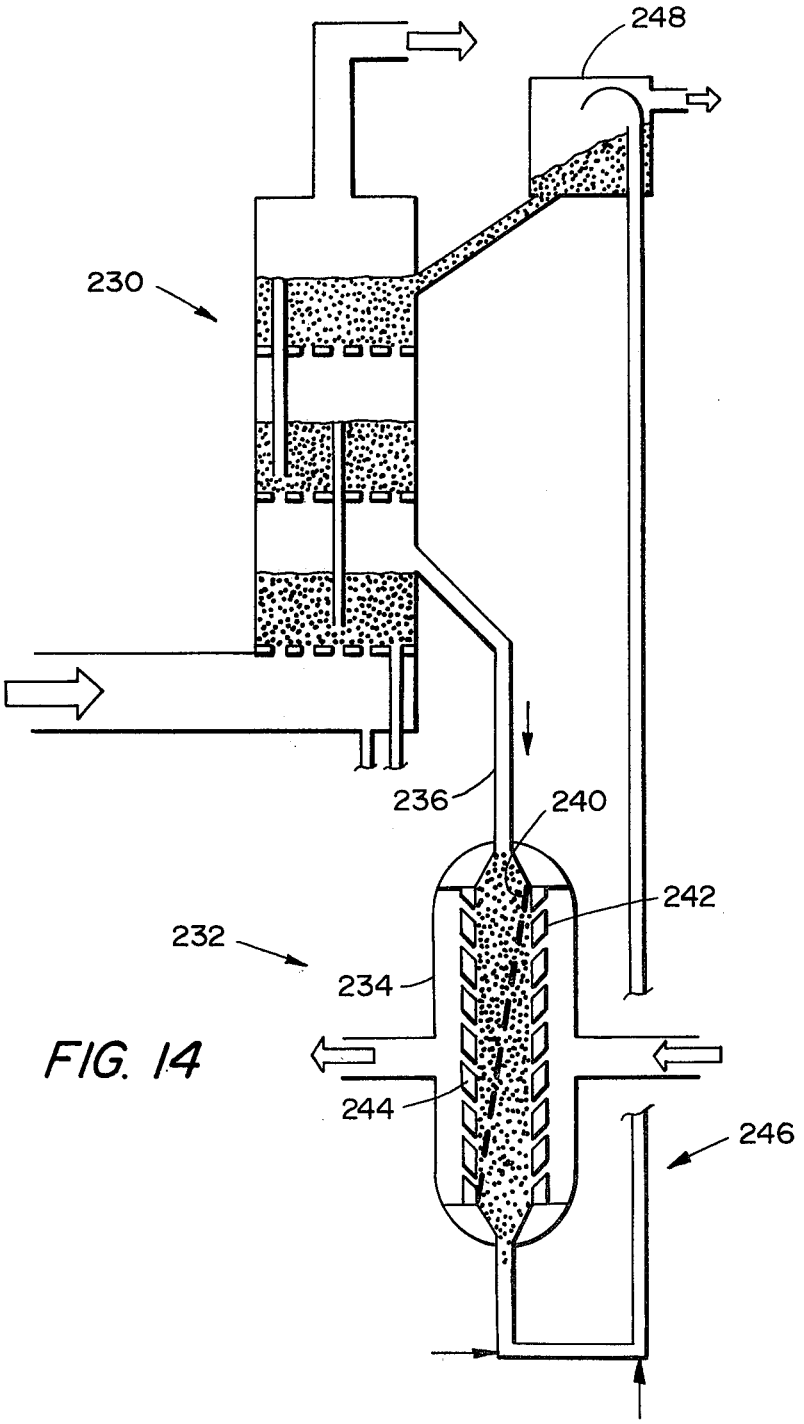
FIG. 14 is a diagrammatic view of an alternative embodiment of the invention having a single vertical panel heat exchanger with continuous media flows to transfer heat to the second gas stream which is directed through the single vertical panel heat exchanger.

A second alternative embodiment of the high temperature heat exchanger is shown in FIG. 14. This embodiment includes a fluid bed heat exchanger unit 230 which is similar in operation and design as the fluid bed heat exchanger unit 22 of FIG. 1. The vertical panel heat exchanger unit 232 differs form the vertical panel heat exchanger unit 24 of the embodiment of FIG. 1 in that only one vertical panel heat exchanger 234 is provided. A single conduit or downcomer 236 conducts the excess granular media from the most upstream fluid bed of the fluid bed heat exchanger unit 230 to the vertical panel heat exchanger 234. The conduit 236 is of sufficient vertical length that the granular media flowing therein provides a pressure seal between the fluid bed heat exchanger unit 230 and the vertical panel heat exchanger unit 232. The media flows steadily down the downcomer 236 and into the panel heat exchanger 232 in a continuous plug flow.

As described earlier, because the high surface area to bulk volume ratio of the media, a relatively sharp temperature demarcation 240 exists in the media. The granular media on the side of the demarcation adjacent the inlet louvres 242 of the second gas stream is essentially at the temperature of the inlet gas stream and the media adjacent the outlet louvres 244 is essentially at the temperature of the media as it enters from the downcomer 236 into the panel heat exchanger 232. As shown in FIG. 14 this demarcation 240 extends from near the inlet louvres at the top of the heat exchanger to near the outlet louvres at the bottom of the heat exchanger.

Such an arrangement eliminates the necessity of using hot media valves such as valves 68 and 72 of the embodiment in FIG. 1, which hot media valves can be quite costly, and also eliminates the need for a second vertical panel heat exchanger. However such an arrangement can only be employed if the pressure differential between the hot contaminated gas stream and the second gas stream is not too great. Otherwise, the height of the hot media downcomer 236 would be unwieldy.

Also depicted in FIG. 14 is a pneumatic lift arrangement 246 which is similar in construction and operation to the pneumatic lift arrangement 104 of FIG. 1. That is to say the cooled media from the vertical panel heat exchanger 234 is lifted through the pneumatic lift arrangement 246 to a media disengagement vessel 248 which operates much the same as media disengagement vessel 112 in FIG. 1. From media disengagement vessel 248, the clean media is conducted back to the fluid bed heat exchanger unit 230 and the lift air which contains the contaminates as dust particles is conducted to appropriate separation apparatus.

Figure 15:
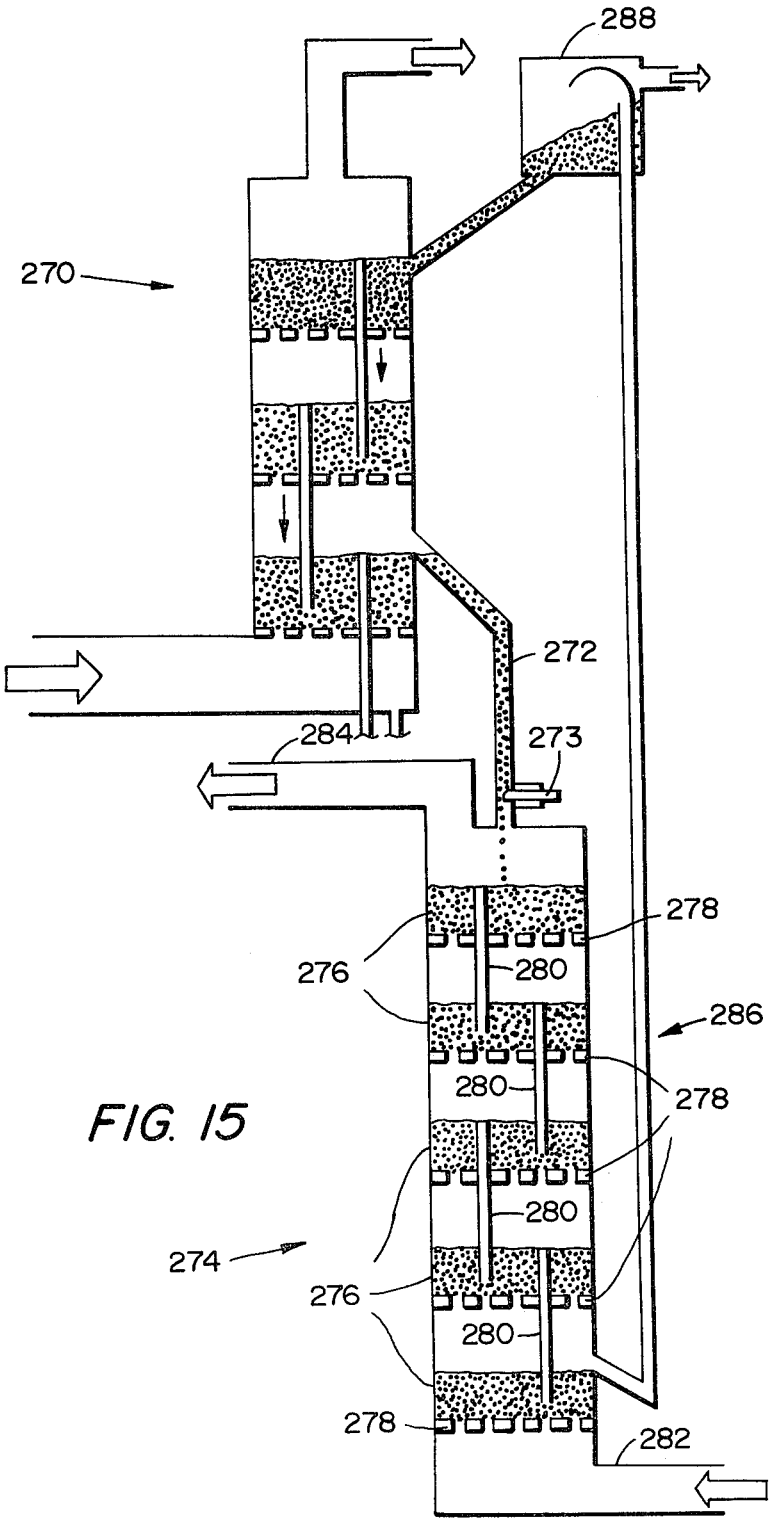
FIG. 15 is a diagrammatical view of still another embodiment of the invention wherein a second fluid bed heat exchanger is used to transfer heat from the contaminated granular media to the second gas stream.

A third alternate embodiment is depicted in FIG. 15. This embodiment includes a fluid bed heat exchanger unit 270 which is similar in construction and operation to the fluid bed heat exchanger unit 22 of the embodiment of FIG. 1. A conduit or downcomer 272 directs the overflow of granular media from the most upstream fluid bed to a second fluid bed heat exchanger unit 274. The downcomer is of sufficient length to provide a pressure seal between the first and second fluid bed heat exchanger units. In an exemplary embodiment with a dense refractory granular media, and a 10 psi pressure differential between the first and second fluid bed heat exchanger units, a downcomer would have to be approximately 11.5 ft. long. As with the embodiment of FIG. 14, the downcomer forms a pressure seal and the need for a hot media valve is eliminated. However, again if the pressure differential between the first and second fluid bed heat exchanger units is great, the length of an appropriate downcomer to provide an adequate pressure seal would become unwieldy.

A flow restrictor or orifice 273 is provided in the downcomer 272 to modulate the rate of flow of media through downcomer 272 into the second fluid bed heat exchanger unit 274.

The second fluid bed heat exchanger unit 274 is comprised of a plurality of staged fluid bed heat exchangers 276 which are connected in a series arrangement as are the fluid beds of fluid bed heat exchanger unit 270. The fluid bed heat exchangers include distributor plates 278 and downcomer conduits 280 which are similar in design and operation to their counterparts in FIG. 1. In this embodiment, the second fluid stream to be heated enters the second fluid bed heat exchanger unit 274 at port 282 and exits at port 284. The second gas stream flows through the fluid beds 276 serially. The hot media enters the most downstream of the fluid bed heat exchangers 276 and flows concurrently to the second gas stream. The function of the fluid beds 276 is only to heat the incoming gas stream. That is to say unlike the fluid beds of unit 270 fluid beds 276 do not perform a contaminate removal function. As a result, the beds can be optimized for heat transfer with minimum pressure drop and thus made more shallow than the hot gas fluid beds of the fluid bed heat exchanger unit 270.

Accordingly, it is to be understood that the greater number of fluid beds in series in the second fluid bed heat exchanger unit 274, the more closely the exit temperature of the second gas stream exiting through port 284 will approach the temperature of the media provided to the second fluid bed heat exchanger unit 274 from the conduit 272. Because of the reduced bed depth, and hence reduced pressure loss, a somewhat greater number of beds can be tolerated in the second fluid bed heat exchanger 274 than in the fluid bed heat exchanger 270 which handles the hot contaminated gas stream. Also it is noted that because the second fluid bed heat exchanger 274 does not build up a pressure drop as the size of the granular media is reduced, such being the case with the vertical panel heat exchangers of FIG. 1, the limitations on minimum media size and media size variations can be relaxed.

Finally the fluid bed heat exchanger unit 274 includes a pneumatic lift apparatus 286 and a media disengagement vessel 288 which are designed and operate similarly to the corresponding structure of FIG. 1.

A fourth alternate embodiment of the invention is depicted in FIG. 16. Before going into greater detail, it is noted that when the hot contaminated fluid stream is at or below a temperature of 1700° F. the heat thereof may be removed directly from each fluid bed by metallic tubes submerged in the bed. The media is no longer circulated between the beds as is the case with the embodiment of FIG. 1. However, the media of each bed is cleaned as appropriate to maintain good fluidization.

More specifically heat exchanger 300 includes an inlet conduit 302 which directs the hot contaminated fluid stream to a plenum chamber 304 which is similar in operation and design to the plenum chamber of the embodiment in FIG. 1. From the plenum chamber, the hot contaminate fluid stream passes throughout from the first and most upstream fluid bed 306 to a second and intermediate fluid bed 308 to the third and most downstream fluid bed 310. Distributor plates 312, 314 and 316 are associated respectively with the above-mentioned fluid beds. Media addition conduits 318, 320 and 322 and media overflow conduits 324, 325 and 326 are associated with the first second and third fluid beds respectively. A conduit arrangement 327 includes a first coil set 328 having extended surfaces or fins 330, which first coil set 328 is submerged in the media of the first fluid bed. The conduit arrangement 327 includes a second coil set 332 which is disposed in the path of the hot contaminated fluid stream above the granular media of the first fluid bed 306. The first and second coil sets are in fluid communication. Further each fluid bed has similar sets of coils (FIG. 16), and all said coils are connected together in a series arrangement. The conduit arrangement 327 includes an inlet port 334 for the second gas stream, which inlet port introduces the second stream initially into the coils associated with the third and most downstream fluid bed 310. The exit port 336 of the conduit arrangement 327 communicates with the first coil set 328 which is submerged in the first fluid bed 306. Thus it can be seen that the flow of the second gas stream is countercurrent to the flow of the hot contaminated gas stream. It is to be understood that in a preferred embodiment the conduit arrangement 327 is comprised of metallic tubes.

In this embodiment, the granular media does not circulate from fluid bed to fluid bed but remains in the original fluid bed. At these low fluid bed temperatures, of about 1700° F., the common contaminants are generally solid or slightly soft solids. Thus the grinding action of the fluid bed will cause the contaminates to be elutriated and exit through port 338 with the exhaust from the hot gas stream and finally be separated in cyclone 340. Further it is to be noted that the scrubbing action of the bed caused by the turbulent granular media, keeps the bed and the heat transfer surfaces clean. Also it is to be appreciated that depending on the nature of the contaminants, one or more of the beds may trap and accumulate certain contaminants. If this occurs, the media overflow conduits remove the excess media which can be directed to appropriate media cleaning systems (not shown), where the media and contaminants would be separated and the cleaned media returned through the media addition conduit to the respective beds.

Industrial Applicability

To illustrate more clearly the operation of the invention, presented here is a brief description of the design of a 25-$MW_{thermal}$MHD Air Heater.

The hot exhaust gas from an MHD channel enters the heat exchanger 20 (FIG. 1) through duct 26 at a temperature of 3600° F. The gas is flowing at a rate of 20.9 lb/sec and contains 0.4% coal slag along with 4% potassium seed as contaminants in the form of, for example, potassium sulfate ($K_2SO_4$), potassium hydroxide (KOH) and potassium carbonate ($K_2CO_3$). At this temperature the coal slag is mostly liquid, but includes, some vapor and the potassium seed is completely vaporized. It is noted that the potassium seed material is introduced into the MHD heater as, for example, potassium carbonate ($K_2CO_3$) to enhance the conductivity. The pressure of the hot gas is 22.8 psia.

As this hot gas passes through the plenum chamber 28 it loses approximately 40% of its liquid slag by impact on the surfaces of the plenum chamber while making the necessary changes in direction and velocity to penetrate the distributor plate 30. As shown in FIG. 2, the main flow area in the plenum chamber is composed of five channels 42 sloping upward in the direction of flow. The hot gas leaves a diffuser exit (2.5 ft×2.5 ft) of the duct 26 at 200 ft/sec and is directed through a transition zone where the area is constantly increasing, causing the gas to decelerate into the channels. Large particles of slag entrained in the gas stream impact the upward sloping channels and the leading edge of the islands 46. This slag flows up the channel against gravity, driven by the hot gas flow, and collects in reservoirs 44 and drains from the plenum slag drain 38. This slag flowing along the channel, produces a thick layer which is excellent for insulation. All surfaces of the plenum chamber are constructed of refractory material cooled by fluid passing through associated high pressure boiler tubes. The hot gas cools from 3600° F. to 3500° F. as heat is transferred to the walls of the plenum chamber at a pressure of approximately 24 psia.

Figure 6:
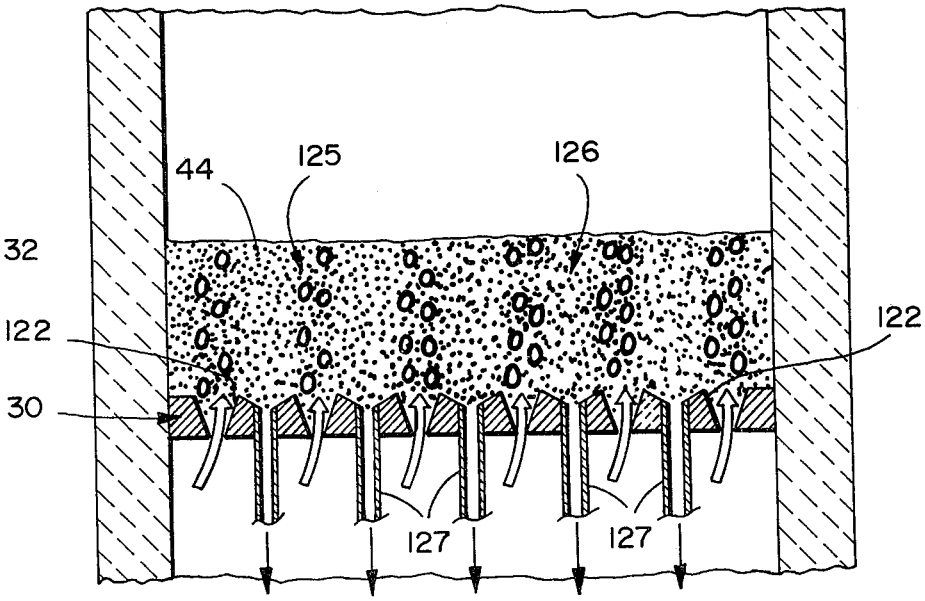
FIG. 6 is a cross-sectional view of a fluid bed heat exchanger which is incorporated in the embodiment of the invention of FIG. 1.

As seen from FIG. 2, the islands 46 between the channels are placed directly under apertures in the distributor plate 30 with only two inches between the top of the islands and the bottom of the distributor plate. The purpose of this design, as previously indicated, is to prevent the media from flowing out of the bed when the bed is not in operation. Again as shown in FIG. 6, the natural angle of repose for the media stops the flow from the aperture before the media spills over the edge of the island. The apertures are three-inch in diameter at the throat and include sharply divergent flow passages designed specifically to preclude plugging.

As shown in FIG. 4, the gas flowing over the surface of the islands accelerates to 240 ft/sec as it approaches the apertures in the distributor plate. The gas accelerate to 650 ft/sec through the apertures.

The granular media is a corrosion resistant ceramic, 2 mm±0.2 mm in diameter, of generally spherical shape with a density of 208 lb/cu ft. The fluid beds 32, 34 and 36 have a static bed depth of 2 ft and a superficial velocity of 25 ft/sec. Minimum fluidization velocity for this media is calculated as 11 ft/sec and the entrainment or maximum fluidization velocity, at which velocity the media is blown from the bed, is calculated to be 73 ft/sec. Pressure drop through the media and distributor plate of the beds is 2.2 psi. Further each of the fluid beds contains approximately 14,000 lb of media.

The media flow rate countercurrent to the gas flow is 18.8 lb/sec the temperature in the fluid beds 32, 34 and 36 are 3120° F., 2580° F. and 1840° F., respectively. At the temperature of 1840° F., the pressure in bed 36 is about 17.2 psia. The media flowing into the 3120° F. fluid bed from the 2580° F. fluid bed will be heated to 3120° F. in approximately eight seconds. Media in each bed has a residence time of 12 minutes, hence thermal equilibrium is easily achieved.

The first fluid bed 32 removes 85% of the coal slag received from the gas and deliver the majority of it to the liquid slag outlet. The level of slag contamination in the first bed is calculated as 0.0085 lb slag/lb media. The level of slag contamination of the media draining from the second to the first fluid bed is calculated as 0.0003 lb slag/lb media.

Slag not retained in the first fluid bed will penetrate to the second fluid bed downstream. At 2580° F. the slag is still a liquid and the vast majority of it will adhere to the media, being ultimately returned to the first fluid bed by the circulating media. The potassium seed will pass through the 3120° F. first fluid bed and the 2580° F.second fluid bed as a vapor.

Recovery of at least 95% of the potassium seed is essential to the economical operation of an MHD power plant. One mechanism for the loss of seed is to have it dissolve in the coal slag. Fortunately, at elevated temperatures above 2500° F. there is relatively little absorption of the potassium vapor by the slag. Hence, the separation of the majority of the coal slag from the seed vapor in the 3120° F. and 2580° F. beds is highly desirable.

The potassium seed, generally in the form of $K_2SO_4$ or $K_2CO_3$ will condense from the hot gas stream as a liquid at a temperature of approximately 2210° F. and freeze as a solid at a temperature of approximately 1950° F. Liquid seed is highly corrosive to metal parts. The third and most downstream fluid bed is designed to operate at 1840° F. specifically to condense the potassium seed vapor from 2580° F. directly to a solid at 1840° F., avoiding entirely the liquid phase. The solid seed particles will largely be ground up by the action of the bed and elutriated with the exit gas for easy collection by the cyclone. If some of the seed does cling to the media, a separation stage can be introduced as illustrated in FIG. 13.

Each of the hot gas fluid beds is approximately 8 ft. in internal diameter. The assembly of the three beds is approximately 11 ft in diameter and 25 ft high.

Media at 3120° F. drains from the first, and most upstream bed, into the vertical panel heat exchanger unit 22 through two 6-in. internal diameter downcomer conduits 56 and 58 at a velocity of 0.7 ft/sec. Each of the vertical panel heat exchangers is 9 ft in diameter and 21 ft high (FIG. 7). The panel is 12 ft high, 6.5 ft wide and 2 ft deep in the direction of air flow. Switchover between the media filling operation and second gas stream heating operation occurs every 23 minutes. Each heat exchanger holds 25,000 lb of media.

Media 2 mm in diameter has 460 sq. ft., of surface area per cu. ft., of packed volume. As a result, heat transfer from the media at 3120° F. to the air at 800° F. is excellent. For these conditions it takes each granular medium only 65 seconds to cool from 3120° F. to approximately 800° F. The net effort is to produce a rather well defined cool media front that moves from the inlet louvre surface to the exit louvre surface during the 23 minute cycle time. The front is perhaps 13 medium diameters in width. The result is to produce an exit air temperature close to the hot media temperature which is nearly uniform over the entire cycle.

Cooling the media from 3100° F. to 800° F. would produce untenable thermal stress in the media were it not for its diminutive size. In this small size, the length of the heat flow path in the material is sufficiently small to preclude thermal stress beyond the capability of the refractory.

The average velocity of the 800° F. incoming air over the inlet face of the panel is 0.58 ft/sec at a point just past the inlet louvres. The average velocity of the air exiting the exit face of the panel, heated to nearly 3100° F., is 1.58 ft/sec. This is the exit velocity of the air just prior to the air passing through the exit louvres. The pressure drop across the panel is 11 psi at a pressure level of 200 psia.

FIG. 9 as previously indicated is a view of the inlet louvres. Specially shaped high-density (197 lb/cu ft) alumina bricks 134 rest on internally cooled one-inch O.D. 316 stainless steel horizontal tubes 135 and 2.5-in. O.D. 316 stainless steel horizontal tubes 136 to form the structure. The bricks are set at a 35° angle and are free to move horizontally to resist thermal stress. The design has an open area of 37% and a local air inlet velocity of 1.4 ft/sec through the inlet louvres.

FIGS. 10 and 11 as previously indicated are views of the outlet louvres of the panel. These louvres are at nearly 3100° F., all of the time, and are constructed of specially designed corrosion resistant bricks. The bricks, as previously described, are set at a 45° angle and are kept from sliding by a locking surface. Alternate horizontal rows are constructed from 16"×6" bricks 144 supported between 6"×6" bricks 146 to provide a 30% open area. The exit velocity through the exit louvre is 5.7 ft/sec., approximately half the minimum fluidization velocity of the media as calculated for fluid beds 32, 34 and 36.

Another industrial application is in a heat exchanger unit as depicted in FIG. 1 used as a regenerator to recover the sensible heat from the fuel gas of a coal gasifier. In such an application the temperature of the most upstream fluid bed such as bed 32 of the fluid bed heat exchanger unit 22 should be over 2100° F. Thus most of the troublesome alkali salts that are easily vaporized, which are found in the contaminated gas, are in vapor form. Consequently these alkali salts do not become affixed to the granular media and thus do not travel with the media as it flows to a heat exchanger such as panel heat exchanger 64 to heat a second gas stream. The alkali salts that do become attached to the media are those that are difficult to vaporize. The hot media can be used to heat the second gas stream, which in this application would be clean fuel gas, without contaminating said fuel gas with alkali salts because the alkali salts contained thereon will produce very little alkali vapor at the temperature of the hot media. The clean, heated fuel gas can then be directed to a turbine without encountering corrosion of the turbine blades due to the alkali salts.

For the above discussion alkali salts which are easily vaporized include, for example, alkali chlorides (KCL, NaCL); alkali salts that are difficult to vaporize include, for example, the alkali sulfates ($Na_2SO_4$,$K_2SO_4$).

Other aspects, objects and advantages of this invention can be obtained from a study of the drawings, the disclosure and the appended claims.

What is claimed is:

1. An apparatus for transferring heat from a hot, contaminated fluid stream which can contain contaminants, including solid particles, semi-solid particles, liquid particles, and condensable vapors, into another fluid stream comprising:

a fluid bed heat exchanger means, including a housing means for containing media, for providing an exchange of heat between the hot, contaminated fluid and the granular media;

a first conduit means in fluid communication with the fluid bed for directing the contaminated fluid stream to the fluid bed heat exchanger means;

the housing means having a distributor means for allowing the contaminated fluid stream to fluidize the granular media in the housing, whereupon the granular media retains at least some of the contaminants;

means for maintaining fluidization of the fluid bed heat exchanger means including means for the addition of uncontaminated granular media thereto and means for removal of contaminated granular media therefrom;

another heat exchanger;

a second conduit means in fluid communication with the removal means and the second conduit means for delivering contaminated granular media to the another heat exchanger; and means for directing the another fluid stream through the another heat exchanger;

wherein the fluid bed heat exchanger means includes at least a first fluid bed defined by a first housing containing granular material and a second fluid bed defined by a second housing containing granular media;

the apparatus including fifth conduit means providing communication between the first and second housings for communicating the granular media therebetween;

wherein the distributor means includes a first distributor to fluidize the granular media in the first housing and a second distributor to fluidize the granular media in the second housing; and sixth communication means for communicating the hot, dirty fluid between the first and second fluid beds; and wherein the fifth conduit means includes a downcomer having one end positioned in the second fluid bed so as to remove excess granular media from the surface of the mass of granular media thereof and having another end thereof positioned in the first fluid bed so as to deliver granular media to the interior of the mass of granular media thereof.

2. An apparatus for transferring heat from a hot, contaminated fluid stream which can contain contaminants including solid particles, semi-solid particles, liquid particles, and condensable vapors, into another fluid stream comprising:

a fluid bed heat exchanger means, including a housing means for containing media, for providing an exchange of heat between the hot, contaminated fluid and the granular media;

a first conduit means in fluid communication with the fluid bed for directing the contaminated fluid stream to the fluid bed heat exchanger means;

the housing means having a distributor means for allowing the contaminated fluid stream to fluidize the granular media in the housing, whereupon the granular media retains at least some of the contaminants, wherein the distributor means has apertures, and wherein the apertures of the distributor means are positioned therein so as to create active zones and quiescent zones in the fluid bed heat exchanger means, the fluid bed heat exchanger means including drain means communicating with the quiescent zones for draining liquid contaminant therefrom;

means for maintaining fluidization of the fluid bed heat exchanger means including means for the addition of uncontaminated granular media thereto and means for removal of contaminated granular media therefrom;

another heat exchanger;

a second conduit means in fluid communication with the removal means and the second conduit means for delivering contaminated granular media to the another heat exchanger; and means for directing the another fluid stream through the another heat exchanger.

3. An apparatus for transferring heat from a hot, contaminated fluid stream which can contain contaminants including solid particles, semi-solid particles, liquid particles, and condensable vapors, into another fluid stream comprising:

a fluid bed heat exchanger means, including a housing means for containing media, for providing an exchange of heat between the hot, contaminated fluid and the granular media;

a first conduit means in fluid communication with the fluid bed for directing the contaminated fluid stream to the fluid bed heat exchanger means;

the housing means having a distributor means for allowing the contaminated fluid stream to fluidize the granular media in the housing, whereupon the granular media retains at least some of the contaminants;

means for maintaining fluidization of the fluid bed heat exchanger means including means for the addition of uncontaminated granular media thereto and means for removal of contaminated granular media therefrom;

another heat exchanger;

a second conduit means in fluid communication with the removal means and the second conduit means for delivering contaminated granular media to the another heat exchanger;

means for directing the another fluid stream through the another heat exchanger; and wherein the another heat exchanger includes at least a first panel heat exchanger and a second panel heat exchanger which panel heat exchangers include louvres;

wherein the second conduit means includes a fifth conduit and a sixth conduit providing communication for the passage of granular media between the fluid bed heat exchanger means and the first panel heat exchanger and between the fluid bed heat exchanger means and the second panel heat exchanger, respectively;

a first valve for selectively opening and closing the fifth conduit and a second valve for selectively opening and closing the sixth conduit; and wherein the means for directing the another fluid stream, includes means for selectively directing the another fluid stream through the louvres of the first and of the second panel heat exchanger; wherein with the first valve closing the fifth conduit, the directing means directs the another fluid stream through the first panel heat exchanger, and the second valve opens the sixth conduit to allow granular media from the fluid bed heat exchanger means to fluid into the second panel heat exchanger, and with the second valve means closing the sixth conduit means, the directing means directs the another fluid stream through the second panel heat exchanger and the first valve opens the fifth conduit to allow granular media from the fluid bed heat exchanger means to flow into the first panel heat exchanger.

4. An apparatus for transferring heat from a hot, contaminated fluid stream which can contain contaminants including solid particles, semi-solid particles, liquid particles, and condensable vapors, into another fluid stream comprising:

a fluid bed heat exchanger means, including a housing means for containing media, for providing an exchange of heat between the hot, contaminated fluid and the granular media;

a first conduit means in fluid communication with the fluid bed for directing the contaminated fluid stream to the fluid bed heat exchanger means;

the housing means having a distributor means for allowing the contaminated fluid stream to fluidize the granular media in the housing, whereupon the granular media retains at least some of the contaminants;

means for maintaining fluidization of the fluid bed heat exchanger means including means for the addition of uncontaminated granular media thereto and means for removal of contaminated granular media therefrom;

another heat exchanger;

a second conduit means in fluid communication with the removal means and the second conduit means for delivering contaminated granular media to the another heat exchanger; and means for directing the another fluid stream through the another heat exchanger wherein the another heat exchanger includes a panel heat exchanger having inlet louvres which include refractory bricks and pipes on which the bricks are mounted, at least some of the another fluid stream being directed by the directing means through said pipes.

5. The apparatus of claim 4, wherein the pipes are comprised of stainless steel.

6. A method of transferring heat from a hot, contaminated fluid stream which can contain contaminants including solid particles, semi-solid particles, liquid particles, and condensable vapors into another fluid stream comprising the steps of:

fluidizing a bed of granular media by passing the hot, contaminated fluid stream therethrough wherein the fluidizing step includes the step of creating active zones and quiescent zones in the bed and draining liquid contaminant from the quiescent zones of the bed;

simultaneously heating the granular media with the fluid stream and transferring some of the contaminants from the stream to the granular media;

maintaining fluidization of the bed by adding uncontaminated media to the bed and removing contaminated media from the bed;

transferring heat from the contaminated media removed from the bed to the another fluid stream.

7. A method of transferring heat from a hot, contaminated fluid stream which can contain contaminants including solid particles, semi-solid particles, liquid particles, and condensable vapors into another fluid stream comprising the steps of:

fluidizing a bed of granular media by passing the hot, contaminated fluid stream therethrough;

simultaneously heating the granular media with the fluid stream and transferring some of the contaminants from the stream to the granular media;

maintaining fluidization of the bed by adding uncontaminated media to the bed and removing contaminated media from the bed;

transferring heat from the contaminated media removed from the bed to the another fluid stream including the steps of delivering the contaminated granular media from the bed to a panel heat exchanger having louvred sides, directing the another fluid stream through the louvred sides into contact with the media, and removing the media from the panel heat exchanger; and delivering contaminated granular media from the bed to another panel heat exchanger simultaneously with the directing of the another fluid stream into contact with the media of the first mentioned panel heat exchanger.

8. A method of transferring heat from a hot, contaminated fluid stream which can contain contaminants including solid particles, semi-solid particles, liquid particles, alkali salts, and condensable vapors into another fluid stream comprising the steps of:

fluidizing a bed of granular media by passing the hot, contaminated fluid stream therethrough;

simultaneously heating the granular media with the fluid stream and transferring some of the contaminants from the stream to the granular media;

maintaining the fluid bed at a temperature so that a portion the alkali salts are in the form of a vapor;

maintaining fluidization of the bed by adding uncontaminated media to the bed and removing contaminated media from the bed; and transferring heat from the contaminated media removed from the bed to the another fluid stream.

9. The method of claim 8 wherein the maintaining step includes maintaining the fluid bed at over 2100° F.

10. A method of transferring heat from a fluid contaminated with alkali salts comprising the steps of:

directing the fluid serially through a plurality of fluid beds;

directing granular media serially through the plurality of fluid beds countercurrent to the flow of fluid; and maintaining the hottest fluid bed at a temperature so that a portion of the alkali salts are in the form of a vapor.

11. The method of claim 10 wherein the maintaining step includes maintaining the hottest fluid at over 2100° F.

12. A method of transferring heat from a fluid contaminated with potassium sulfate and potassium carbonate comprising the steps of:

directing the fluid serially through a plurality of fluid beds;

directing granular media serially through the plurality of fluid beds countercurrent to the flow of fluid;

maintaining one fluid bed at above 2210° F.; and maintaining the next adjacent fluid bed at below 1950° F. so that the potassium sulfate and the potassium carbonate freeze from a vapor directly into a solid.

* * * * *